United States Patent [19]

Montaruli

[11] 4,111,089

[45] Sep. 5, 1978

[54] REFILLABLE CUTTING DISPENSER

[76] Inventor: Elio Montaruli, Via Salaria 1302, 00138 Rome, Italy

[21] Appl. No.: 750,286

[22] Filed: Dec. 9, 1976

[51] Int. Cl.[2] ..... B26D 5/10

[52] U.S. Cl. ..... 83/542; 83/568; 83/589; 83/649; 225/45

[58] Field of Search ..... 225/45, 44, 46, 80, 225/19, 89; 83/568, 570, 649, 589, 542

[56] References Cited

U.S. PATENT DOCUMENTS

| | | | |
|---|---|---|---|
| 2,710,152 | 6/1955 | Jones | 225/44 X |
| 2,759,545 | 8/1956 | Rizza | 225/45 X |
| 3,489,324 | 1/1970 | Stohl | 225/45 X |
| 3,746,225 | 7/1973 | Runckel | 225/45 X |
| 3,757,626 | 9/1973 | Kulp | 83/649 X |

*Primary Examiner*—Willie G. Abercrombie

[57] ABSTRACT

The dispenser comprises a generally cylindrical or cup-like base member which removably receives a spool of a dispensable and cuttable plastic-coated ribbon or wire which is wound on the spool. The side wall of the base has an opening through which the wire or tape can be fed from the spool. Each spool can be replaced in the base member as it is used up, or a new spool can be inserted at any time, if desired. A disk-like cover member, carrying a central post, forms a tight mechanical fit with the base, with the post engaging the spool, whereby the spool is held in place and can rotate thereon. The base carries an extension plate which carries a cutting mechanism which is generally aligned with the opening in the side wall, the cutting mechanism being provided for cutting, to a desired length, the wire or tape dispensed from the spool.

8 Claims, 6 Drawing Figures

REFILLABLE CUTTING DISPENSER

BACKGROUND OF THE INVENTION

Dispensers of tape, such as adhesive tape, are now well known. These dispensers handle a spool or cartridge of relatively small size since a considerable length of tape, which is very thin, can be accommodated in a small spool or cartridge. Lengths of plastic-coated ribbon or wire are now widely used in the home, retail stores, and industry, for a variety of purposes, for example, to bundle articles such as bags filled with produce, hardware items, or the like, pieces of wood or metal, an innumerable other items.

Dispensers for this type of product are also known, and such dispensers are different from the conventional adhesive tape dispenser, and the cutting mechanism therefor is also different. For one thing, the plastic-coated ribbon is usually provided in a considerably larger roll than the adhesive tape. For this and other reasons, it can be seen that tape and wire ties are so different that the well-known adhesive tape dispenser cannot be easily modified to serve as a wire tie dispenser.

One U.S. patent is known, in U.S. Pat. No. 3,757,626, which shows a dispenser for plastic-coated ribbon or wire. This product does not include a replaceable spool; it does not include a convenient housing; and the relationship between the wire, as it feeds from the spool, and the cutter is undesirably awkward.

The present invention provides a plastic-coated ribbon or wire tie dispenser which has a replaceable spool or cartridge, has a convenient and attractive housing, and has an optimum relationship between the wire and a cutting mechanism.

DESCRIPTION OF THE PREFERRED EMBODIMENTS

Figure 2:
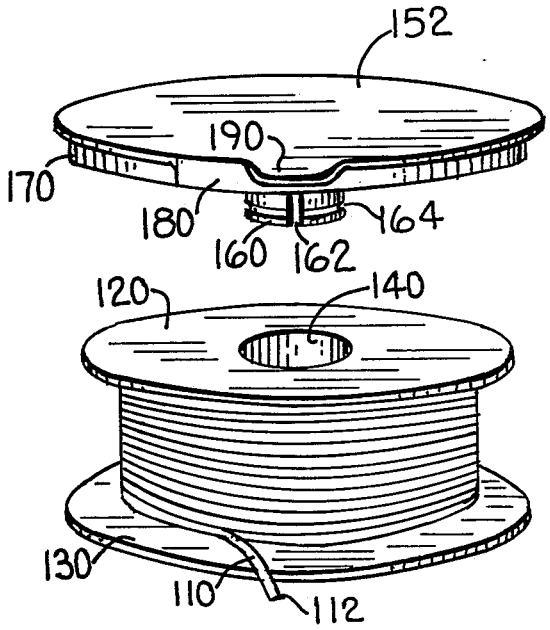
FIG. 2 is a perspective view of the dispenser of FIG. 1 assembled.
Figure 2:
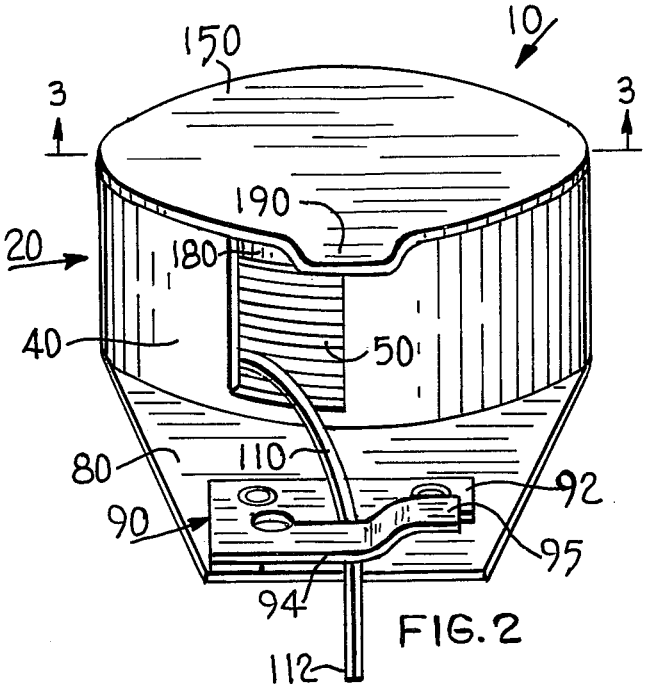
Figure 1:
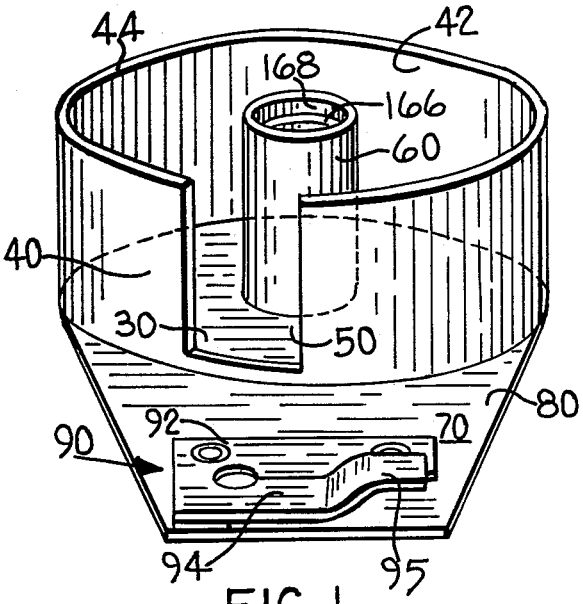
FIG. 1 is a perspective exploded view of the dispenser of the invention.
Figure 3:
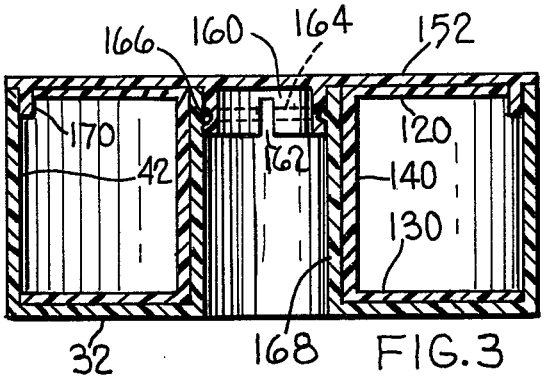
FIG. 3 is a sectional view, along the lines 3—3, in FIG. 2.
Figure 4:
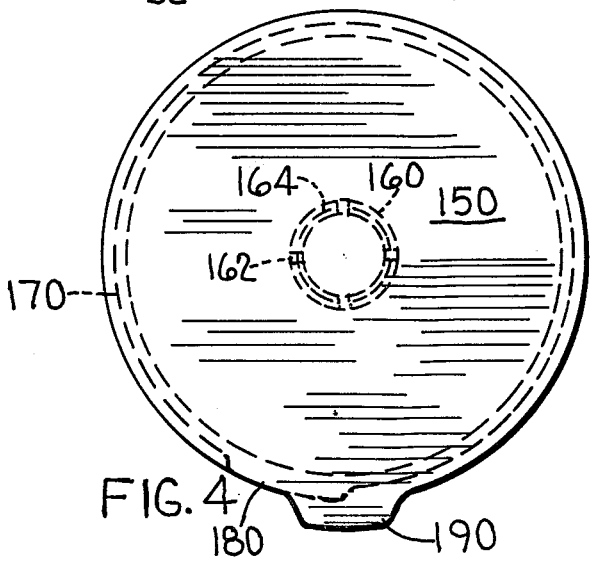
FIG. 4 is a plan view of the cap of the dispenser of FIG. 1.
Figure 5:
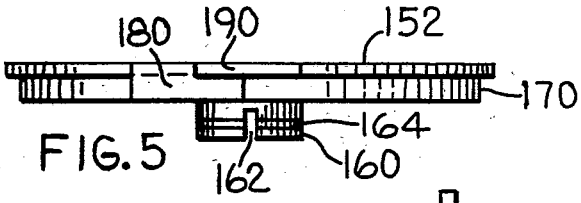
FIG. 5 is a side elevational view of the cap of FIG. 4.
Figure 6:
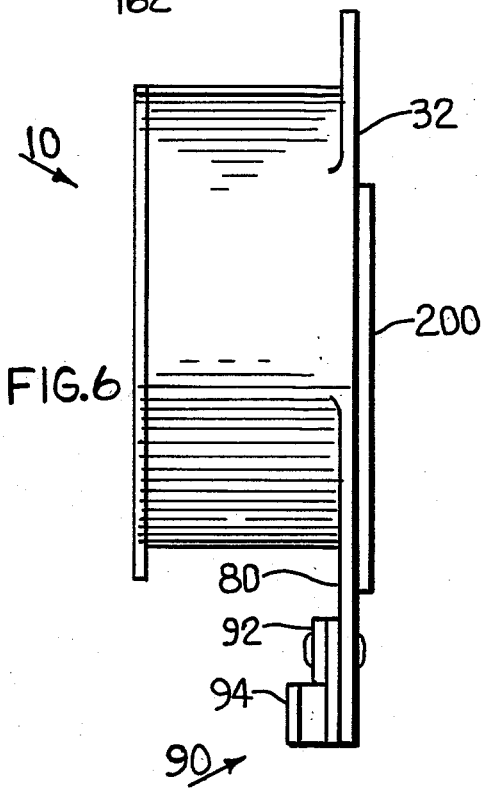
FIG. 6 is a side view of the dispenser of FIG. 1.

Dispensing apparatus 10 embodying the invention is preferably of a synthetic resinous material and comprises a cup-shaped base member 20 having a bottom wall 30 and a side wall 40, the side wall having a generally rectangular opening 50 formed therein and extending downwardly from the upper edge 44 thereof. A post 60 extends upwardly from about the center of the bottom wal of base 30. The cup-shaped base member 20 includes a projecting plate 70, which is an extension of the bottom wall 30, from approximately a diameter thereof. The projecting plate has a top surface 80, on which is secured a wire-cutting apparatus 90 which is disposed directly in line with opening 50 in the side wall.

The cutting apparatus 90 comprises a first metal plate 92, which is fixed to the top surface of the plate 70, and a second metal plate 94, which is also fixed to plate 70, but includes a portion 95 which can be moved vertically up and down with respect to the first metal plate 92 for a purpose to be described. The plates are disposed close together, side by side, with a small line-like space 96 between them. The plates and the space 96 are disposed so that they lie generally transverse to the path which extends from the opening 50 to the cutting mechanism 90.

A spool 100 carrying a length of plastic-coated ribbon or wire 110 is disposed within the cup-shaped base member 30 and comprises a pair of spaced-apart circular plates 120 and 130 with a cylinder 140 between them. The spool 100 is rotatably seated on the post 60 which enters the cylinder relatively snugly. The end 112 of the wire 110 carried on the spool 100 extends out of the aperture 50 in the wall 40 of the cup-shaped member 20 and extends directly and on a straight line to the cutting apparatus 90. The wire is threaded through the space 96 between the two metal plates 92 and 94 so that a length thereof can be cut by depressing the movable plate 94.

The apparatus of the invention is completed by a circular cap 150 which has a top surface 152 and a bottom surface 154. The bottom surface carries, at about its center, a short post 160 which enters the cylinder 60 of the spool 100. The post has a plurality of slots 162 in its wall so that the post can be compressed when it is inserted into the cylinder 140 in spool 100. The post 160 on cap 150 is provided with an annular depression 164 which is engaged by an annular ridge 166 on the inner wall 168 of post 60 on the base member 20 to securely lock the cap to the base. If desired, the ridge 166 and depression could be reversed.

The cap 150 also includes a short, vertical wall 170 near its perimeter which forms a tight fit with the inner surface 42 of the upper end of the wall 40 of the cup-shaped member (FIG. 2). The vertical wall 170 includes a thickened portion 180 which is adapted to be positioned in the aperture 50 in the wall when the cap is set in place to keep the cap from rotating. The upper surface of the cap also includes a projecting tab 190 which is adapted to be engaged by the user's finger when it is desired to remove the cap from the assembly 10.

If desired, the dispenser 10 may be provided with a piece 200 of double-faced adhesive tape on the rear surface 32 of the bottom wall 30 of base member 20 so that the dispenser can be mounted on a wall or other support surface.

It can be seen that the dispenser 10 has the advantage that its parts form a tight and compact package, it is refillable, and spools of tape or wire of different colors can be used. In addition, the positioning and alignment of the wall opening 50 with cutter 90 simplifies the drawing of the wire through the opening 50, directly to cutter 90, threading the wire between plates 92 and 94, and depressing of plate 94 to cut the wire to any desired length.

Various modifications in the dispenser described above may be made within the scope of the invention. For example, the spool need not be mounted for rotation on a post in the housing; it could rotate freely in the housing itself, held in place by the side wall of the housing. In addition, the size of the aperture in the side wall can be varied as required.

What is claimed is:

1. A refillable dispenser comprising a cup-shaped member including a base, a cylindrical side wall having an opening therein, and a closure cap, an extension of said base extending beyond said cylindrical wall, generally in alignment with said opening in said cylindrical side wall, a central vertical post secured to said base inside said cup-shaped member, a spool carrying a length of wire, or the like, rotatably mounted on said post within said cup-shaped member, the leading end of said wire extending out of said cup-shaped member from said spool through said opening in said side wall, said closure cap being removably seated on the upper rim of said side wall and forming a tight fit therewith, and a cutting mechanism secured to the top surface of said extension of said base member and generally aligned with said opening in said side wall so that said wire can be fed directly thereto and a length can be cut therefrom, said cutter comprising a first plate and a second plate disposed on the top surface of said extension generally parallel to each other with a small space between them, said plates being disposed generally transverse to the path of said wire from said spool and out of said opening to said cutting mechanism, said first plate being secured flat to the top surface of said extension and said second plate being generally rectangular and secured at one end to said top surface of said extension whereby said second plate can be moved up and down with respect to said first plate to cut said wire which is between them.

2. The apparatus defined in claim 1 and including means on the rear surface of said base for securing said dispenser to a supporting member to facilitate operation thereof.

3. The apparatus defined in claim 1 wherein said cap includes a depending circular wall which engages and forms a tight fit with the side wall of said base member.

4. The apparatus defined in claim 3 wherein said cap also includes a tab which seats in said opening in said side wall when said cap is in place on said base member.

5. The appratus defined in claim 4 wherein said cap includes a projecting tab which can be engaged by a user to remove said cap from said base member to provide access to said spool.

6. The apparatus defined in claim 1 wherein said side wall has an upper circular edge and said opening is generally rectangular in shape and extends downwardly from said upper edge into the body of said side wall.

7. The apparatus defined in claim 3 wherein said central post and said circular wall are provided with means for locking them together.

8. The apparatus defined in claim 3 wherein said central post carries an annular ridge and said dependent circular wall carries an annular depression, said depression and said ridge engaging each other to lock said cap to said base member.

* * * * *